US009528805B2

(12) United States Patent
Seeman et al.

(10) Patent No.: US 9,528,805 B2
(45) Date of Patent: Dec. 27, 2016

(54) PROVIDING SPIN TO COMPOSITE PROJECTILE

(71) Applicant: EINSTEIN NOODLES, LLC, Charleston, SC (US)

(72) Inventors: Daniel Jonathan Seeman, Charlotte, NC (US); Dewey R. Privette, Charlotte, NC (US)

(73) Assignee: Einstein Noodles, LLC, Charleston, SC (US)

( * ) Notice: Subject to any disclaimer, the term of this patent is extended or adjusted under 35 U.S.C. 154(b) by 76 days.

(21) Appl. No.: 14/678,989

(22) Filed: Apr. 5, 2015

(65) Prior Publication Data

US 2016/0290773 A1 Oct. 6, 2016

Related U.S. Application Data

(60) Provisional application No. 61/976,248, filed on Apr. 7, 2014.

(51) Int. Cl.

| | |
|---|---|
| ***F42B 10/00*** | (2006.01) |
| ***F42B 12/74*** | (2006.01) |
| ***F42B 12/78*** | (2006.01) |
| ***F42B 5/02*** | (2006.01) |
| ***F42B 33/00*** | (2006.01) |

(52) U.S. Cl.

CPC ..... *F42B 12/745* (2013.01); *F42B 5/02* (2013.01); *F42B 12/78* (2013.01); *F42B 33/00* (2013.01)

(58) Field of Classification Search

CPC ..... F42B 12/745; F42B 12/78; F42B 5/02; F42B 33/00

See application file for complete search history.

(56) References Cited

U.S. PATENT DOCUMENTS

| | | | |
|---|---|---|---|
| 2,835,198 | A | 5/1958 | Brombacher |
| 5,237,930 | A | 8/1993 | Belanger et al. |

(Continued)

FOREIGN PATENT DOCUMENTS

| | | | |
|---|---|---|---|
| WO | 2014193497 | A2 | 12/2014 |
| WO | 2014193497 | A3 | 5/2015 |
| WO | WO2015199786 | A2 | 12/2015 |

OTHER PUBLICATIONS

"International Search Report" and "Written Opinion of the International Searching Authority" (ISA/US) in Caneel Associates, Inc., International Patent Application Serial No. PCT/US2014/17516, mailed Mar. 17, 2015 (6 pages).

(Continued)

*Primary Examiner* — Samir Abdosh

(74) *Attorney, Agent, or Firm* — Roeder & Broder LLP; James P. Broder

(57) ABSTRACT

A projectile includes a body preferably in the shape of a bullet and having a density less than the density of lead. The projectile further includes a stabilizer adhered to the body. The stabilizer is configured to engage rifling of a barrel of a firearm and impart rotation to the projectile as the projectile travels through the barrel. A preferred ammunition cartridge includes a primer, a propellant, and the aforesaid projectile, as well as a casing containing the primer, propellant and projectile, with the projectile projecting from the casing. Other projectiles in accordance with aspects and features of the invention further are disclosed.

20 Claims, 2 Drawing Sheets

(56) References Cited

U.S. PATENT DOCUMENTS

| | | | | |
|---|---|---|---|---|
| 5,399,187 | A | 3/1995 | Mravic et al. | |
| 5,616,642 | A | 4/1997 | West et al. | |
| 5,665,808 | A | 9/1997 | Bilsbury et al. | |
| 5,786,416 | A | 7/1998 | Gardner et al. | |
| 6,048,379 | A | 4/2000 | Bray et al. | |
| 6,257,149 | B1 | 7/2001 | Cesaroni | |
| 6,630,231 | B2 | 10/2003 | Perez et al. | |
| 6,823,798 | B2 | 11/2004 | Amick | |
| 6,916,354 | B2 | 7/2005 | Elliott | |
| 7,353,756 | B2 | 4/2008 | LeaSure | |
| 8,347,788 | B1 | 1/2013 | LeaSure | |
| 8,689,696 | B1 * | 4/2014 | Seeman | F42B 5/02 102/439 |
| 9,212,878 | B2 * | 12/2015 | Seeman | F42B 12/74 |
| 9,322,623 | B2 * | 4/2016 | Seeman | F42B 12/74 |
| 2004/0138361 | A1 | 7/2004 | Cheng | |
| 2010/0282117 | A1 * | 11/2010 | Cranor | F42B 12/40 102/513 |
| 2015/0075400 | A1 | 3/2015 | Lemke et al. | |
| 2015/0276361 | A1 * | 10/2015 | Seeman | F42B 5/02 86/18 |
| 2015/0308804 | A1 * | 10/2015 | Seeman | F42B 12/74 102/430 |
| 2016/0252336 | A1 * | 9/2016 | Seeman | F42B 12/74 |
| 2016/0290773 | A1 * | 10/2016 | Seeman | F42B 12/745 |

OTHER PUBLICATIONS

"Injection Molded Bullets" Guns & Ammo Journal, Jul. 2015 Issue, pp. 69-72, 74, 76, and 77 (8 pages).

Product Information Sheet by The Dow Chemical Company. Form No. 296-01909-0910-RX, downloaded Feb. 3, 2014 from (http://msdssearch.dow.com/PublishedLiteratureDOWCOM/dh_0876/0901b80380876565.pdf?filepath+epoxy/pdfs/noreg/296-01909pdf&fromPage+GetDoc), (4pages).

Dow Epoxy Announces new FORTEGA(TM) Toughening Technologies, Press Release by The Dow Chemical Company, Mar. 29, 2011, downloaded Feb. 3, 2014 from (http://epoxy.dow.com/news/2011/20110505b.htm), (2 pages).

* cited by examiner

PROVIDING SPIN TO COMPOSITE PROJECTILE

COPYRIGHT STATEMENT

All of the material in this patent document is subject to copyright protection under the copyright laws of the United States and other countries. The copyright owner has no objection to the facsimile reproduction by anyone of the patent document or the patent disclosure, as it appears in official governmental records, but all other copyright rights whatsoever are reserved.

BACKGROUND OF THE INVENTION

This invention relates generally to projectiles, and more particularly, to composite projectiles and ammunition incorporating composite projectiles.

Conventional small arms ammunition comprises a cartridge having a casing loaded with a propellant powder and a projectile (e.g., a bullet). An impact-sensitive primer ignites the propellant when struck by a gun's firing pin. Projectiles for such ammunition are most typically made from lead or lead alloys. This material has a high density providing good velocity retention, range, muzzle energy, and target penetration, while being soft enough not to engage the rifling in a barrel without damaging the barrel.

Unfortunately, lead is a source of both indoor and outdoor pollution, and is also rising in cost. Attempts have been made in the prior art to replace lead in projectiles. However, these materials have either been expensive (e.g., tungsten) or have significant performance limitations in terms of structural integrity and target penetration (e.g., polymers). Furthermore, even when projectiles are made from lead, their expansion characteristics (and related temporary and permanent wounding effects) are limited when incorporated into pistol ammunition, because of the relatively low muzzle energy levels that can be safely generated in a pistol. This limits the so-called "stopping power" of conventional pistol ammunition.

Other attempts have been made to replace lead in projectiles, as evidenced, for example, by U.S. Pat. No. 5,237,930; U.S. Pat. No. 5,399,187; U.S. Pat. No. 5,616,642; U.S. Pat. No. 5,786,416; U.S. Pat. No. 6,048,379; U.S. Pat. No. 6,630,231; U.S. Pat. No. 6,823,798; and U.S. Pat. No. 8,689,696.

With regard to composite projectiles that have been made in accordance with one or more embodiments disclosed in U.S. Pat. No. 8,689,696—and ammunition incorporating such composite projectiles, it is believed that such projectiles may tumble when fired from a pistol or rifle. While not necessarily disadvantageous at short distances typically encountered in self-defense shootings, tumbling can be disadvantageous when shooting at medium and long range distances, as tumbling is believed to result in a loss of shooting accuracy and precision. Conventionally, spinning of a projectile about the longitudinal axis of a barrel of a pistol or rifle resulting from the rifling of a barrel is believed to keep the projectile from tumbling. The composite projectiles that have been made in accordance with one or more embodiments disclosed in U.S. Pat. No. 8,689,696 are believed to be of insufficient diameter and/or insufficient in some other characteristic (e.g., too 'soft') for adequately engaging rifling of a barrel so as to impart rotation to the projectile as it advances through the barrel.

In view of the foregoing, it is believed that a need exists for a way of providing spinning to composite projectiles that are made in accordance with one or more embodiments disclosed in U.S. Pat. No. 8,689,696. One or more aspects and features of the present invention are believed to address such perceived need.

SUMMARY OF THE INVENTION

The present invention includes many aspects and features.

In a first aspect of the invention, a projectile for a firearm comprises a polymer bullet; and a stabilizer bonded to the polymer bullet and configured to engage rifling of a barrel of a firearm and impart rotation to the polymer bullet as the polymer bullet travels through the barrel.

In a feature, the polymer bullet comprises a thermoset.

In another feature, the polymer bullet consists of a mixture, the mixture comprising a thermoset.

In a feature, the polymer bullet consists of a mixture, the mixture comprising a thermoset and a particulate filler distributed through the thermoset.

In a feature, the polymer bullet comprises a thermoplastic.

In a feature, the polymer bullet consists of a mixture, the mixture comprising a thermoplastic.

In a feature, the polymer bullet consists of a mixture, the mixture comprising a thermoplastic and a particulate filler distributed through the thermoplastic.

In another aspect, a projectile for a firearm includes a non-metallic bullet; and a stabilizer bonded to the non-metallic bullet and configured to engage rifling of a barrel of a firearm and impart rotation to the non-metallic bullet as the non-metallic bullet travels through the barrel.

In a feature, the non-metallic bullet comprises a wood bullet.

In a feature, the non-metallic bullet comprises a wax bullet.

In a feature, the non-metallic bullet comprises a rubber bullet.

In another aspect, a projectile for a firearm comprises: a polymer resin; and a curative agent by which the polymer resin is cured. The cured polymer resin comprises a resin body having an elongate, generally cylindrical portion extending between opposite longitudinal ends of the resin body. Furthermore, the projectile further comprises a stabilizer bonded to the resin body and configured to engage rifling of a barrel of a firearm and impart rotation to the projectile as the projectile travels through the barrel.

In a feature, the projectile further comprises a particulate filler distributed in and through the resin.

In a feature, the filler has a density greater than a density of the resin.

In a feature, the projectile has an average density less than the density of lead.

In another aspect, a projectile for a firearm, comprises: a toughened polymer resin comprising an elastomer-modified epoxy functional adduct formed by the reaction of a bisphenol A liquid epoxy resin and a carboxyl terminated butadiene-acrylonitrile elastomer; a particulate filler distributed through the resin; and a curative agent by which the toughened polymer resin with distributed particulate filler is cured. The cured toughened polymer resin with distributed particulate filler comprises a resin body having an elongate, generally cylindrical portion extending between opposite longitudinal ends of the resin body. The projectile further comprises a stabilizer bonded to the resin body and configured to engage rifling of a barrel of a firearm and impart rotation to the projectile as the projectile travels through the barrel.

In a feature, the stabilizer has a sufficient hardness relative to the resin body so as to engage the rifling of a barrel of a firearm and impart rotation to the projectile as the projectile travels through the barrel.

In a feature, the resin body is symmetrical about a longitudinal axis of the resin body extending between opposite longitudinal ends of the resin body.

In a feature, the stabilizer is symmetrical about a longitudinal axis of the resin body extending between opposite longitudinal ends of the resin body.

In additional features, which may be mutually exclusive: the stabilizer comprises a plate having a first generally circular cross-sectional profile; the resin body has a second generally circular cross-sectional profile and the second generally circular cross-sectional profile is approximately the same diameter as the first generally circular cross-sectional profile; and the resin body has a second generally circular cross-sectional profile and the first generally circular cross-sectional profile of the stabilizer is greater in diameter than the first generally circular cross-sectional profile.

In a feature, the stabilizer is bonded to one of the opposite longitudinal ends of the resin body.

In a feature, the opposite longitudinal ends of the resin body comprise a nose and a base, and wherein the stabilizer is bonded to the base.

In a feature, the stabilizer is bonded to and divides the generally cylindrical portion of the resin body.

In a feature, the stabilizer is made of copper.

In a feature, the stabilizer is made of zinc.

In a feature, the stabilizer is made of brass.

In a feature, the stabilizer is made of lead.

In a feature, the stabilizer defines a plurality of holes extending longitudinally there through and within which the resin extends.

In a feature, the stabilizer has the shape of a disc.

In a feature, the stabilizer has the shape of an annulus.

In a feature, the stabilizer has the shape of a washer.

In a feature, the resin body has an average density less than the density of lead.

In a feature, the filler has a density greater than a density of the resin.

In a feature, the resin body has an average density less than 45 percent of the density of lead.

In a feature, the filler is selected from the group consisting of: copper, tungsten, lead, depleted uranium, bismuth, bronze, iron and steel, ceramic, clay, mica, silica, calcium carbide, a micro-encapsulated material, and combinations thereof.

In a feature, the resin is 20 to 30 weight percent of the total composition of the resin body.

In a feature, the filler is 70 to 80 weight percent of the total composition of the resin body.

In a feature, the filler comprises tungsten.

In a feature, the elastomer content is 40 percent by weight of the toughened polymer resin.

In a feature, the resin body has the shape of a bullet.

In another aspect, an ammunition cartridge for a firearm comprises: a propellant; and a projectile fixed in position relative to the propellant. The projectile comprises a toughened polymer resin comprising an elastomer-modified epoxy functional adduct formed by the reaction of a bisphenol A liquid epoxy resin and a carboxyl terminated butadiene-acrylonitrile elastomer; a particulate filler distributed through the resin; and a curative agent by which the toughened polymer resin with distributed particulate filler is cured. The cured toughened polymer resin with distributed particulate filler comprises a resin body having an elongate, generally cylindrical portion extending between opposite longitudinal ends of the resin body. The projectile further comprises a stabilizer bonded to the resin body and configured to engage rifling of a barrel of a firearm and impart rotation to the projectile as the projectile travels through the barrel.

In a feature, the filler has a density greater than a density of the resin

In a feature, the resin body has an average density less than 45 percent of the density of lead.

In a feature, the resin is 20 to 30 weight percent of the total projectile composition.

In a feature, the filler is 70 to 80 weight percent of the total projectile composition.

In a feature, the filler comprises tungsten.

In a feature, the elastomer content is 40 percent by weight of the toughened polymer resin.

In a feature, the filler is selected from the group consisting of: copper, tungsten, lead, depleted uranium, bismuth, bronze, iron and steel, ceramic, clay, mica, silica, calcium carbide, a micro-encapsulated material, and combinations thereof.

In a feature, the resin body has the shape of a bullet.

In another aspect, an ammunition cartridge comprises: a primer; a propellant; a projectile; and a casing containing the primer, propellant and projectile, with the projectile projecting from the casing. The projectile comprises a toughened polymer resin comprising an elastomer-modified epoxy functional adduct formed by the reaction of a bisphenol A liquid epoxy resin and a carboxyl terminated butadiene-acrylonitrile elastomer; a particulate filler distributed through the resin; and a curative agent by which the toughened polymer resin with distributed particulate filler is cured. The cured toughened polymer resin with distributed particulate filler comprises a resin body having an elongate, generally cylindrical portion extending between opposite longitudinal ends of the resin body. The projectile further comprises a stabilizer bonded to the resin body and configured to engage rifling of a barrel of a firearm and impart rotation to the projectile as the projectile travels through the barrel.

In a feature, the projectile has an average density less than 45 percent of the density of lead.

In a feature, the resin is 20 to 30 weight percent of the total projectile composition.

In a feature, the filler is 70 to 80 weight percent of the total projectile composition.

In a feature, the filler comprises tungsten.

In a feature, the elastomer content is 40 percent by weight of the toughened polymer resin.

In a feature, the filler is selected from the group consisting of: copper, tungsten, lead, depleted uranium, bismuth, bronze, iron and steel, ceramic, clay, mica, silica, calcium carbide, a micro-encapsulated material, and combinations thereof.

In a feature, the resin body has the shape of a bullet.

In another aspect, a method of making a projectile for an ammunition cartridge for a firearm comprises the step of bonding a stabilizer to a body of a bullet such that the stabilizer is configured to engage rifling of a barrel of a firearm and impart rotation to the body of the bullet as the projectile travels through the barrel.

In a feature, the step of bonding the stabilizer to the body of the bullet comprises placing the stabilizer in a mold for the body of the bullet during the process of molding the body of the bullet.

In a feature, the step of bonding the stabilizer to the body of the bullet comprises adhering the stabilizer to the body of the bullet after removing the body of the bullet from a mold.

In a feature, the body of the bullet is non-metallic.

In a feature, the body of the bullet consists of a mixture, the mixture comprising a thermoset.

In a feature, the mixture further comprises a particulate filler.

In a feature, the body of the bullet consists of a mixture, the mixture comprising a thermoplastic.

In a feature, the mixture further comprises a particulate filler.

In a feature, the body of the bullet comprises rubber.

In a feature, the body of the bullet comprises wood.

In a feature, the body of the bullet comprises wax.

In another aspect, a method of making a projectile for an ammunition cartridge, comprises the steps of: mixing together to form a mixture an elastomer-modified epoxy functional adduct formed by the reaction of a bisphenol A liquid epoxy resin and a carboxyl terminated butadiene-acrylonitrile elastomer, and a curative agent; introducing the mixture into a projectile mold having a cavity in a desired projectile shape; allowing the resin to cure so as to form a resin body having an elongate, generally cylindrical portion extending between opposite longitudinal ends of the resin body; and removing the projectile from the mold. The method additionally comprises the step of bonding a stabilizer to the resin body such that the stabilizer is configured to engage rifling of a barrel of a firearm and impart rotation to the projectile as the projectile travels through the barrel.

In a feature, the step of bonding the stabilizer to the resin body comprises placing the stabilizer in the mold prior to allowing the resin to cure.

In a feature, the step of bonding the stabilizer to the resin body comprises adhering the stabilizer to the resin body after removing the resin body from the mold.

In another aspect, a method of making a projectile for an ammunition cartridge comprises the steps of: mixing together to form a mixture an elastomer-modified epoxy functional adduct formed by the reaction of a bisphenol A liquid epoxy resin and a carboxyl terminated butadiene-acrylonitrile elastomer, a particulate filler, and a curative agent; introducing the mixture into a projectile mold having a cavity in a desired projectile shape; allowing the resin to cure so as to form a resin body having an elongate, generally cylindrical portion extending between opposite longitudinal ends of the resin body; and removing the resin body from the mold. The method further comprises the step of bonding a stabilizer to the resin body such that the stabilizer is configured to engage rifling of a barrel of a firearm and impart rotation to the projectile as the projectile travels through the barrel.

In a feature, the filler has a density greater than a density of the resin.

In a feature, the resin body has an average density less than the density of lead.

In a feature, the step of bonding the stabilizer to the resin body comprises placing the stabilizer in the mold prior to allowing the resin to cure.

In a feature, the step of bonding the stabilizer to the resin body comprises adhering the stabilizer to the resin body after removing the resin body from the mold.

In another aspect, a method of making an ammunition cartridge, comprising the steps of: mixing together to form a mixture an elastomer-modified epoxy functional adduct formed by the reaction of a bisphenol A liquid epoxy resin and a carboxyl terminated butadiene-acrylonitrile elastomer, and a curative agent; introducing the mixture into a projectile mold having a cavity in a desired projectile shape; allowing the resin to cure so as to form a resin body having an elongate, generally cylindrical portion extending between opposite longitudinal ends of the resin body; and removing the resin body from the mold. The method additionally comprises the steps of bonding a stabilizer to the resin body such that the stabilizer is configured to engage rifling of a barrel of a firearm and impart rotation to the resin body as the resin body travels through the barrel; and assembling the resin body and stabilizer, a primer, and a propellant in a bullet casing with a longitudinal end of the resin body projecting from the casing.

In a feature, the step of bonding the stabilizer to the resin body comprises placing the stabilizer in the mold prior to allowing the resin to cure.

In a feature, the step of bonding the stabilizer to the resin body comprises adhering the stabilizer to the resin body after removing the resin body from the mold.

In addition to the aforementioned aspects and features of the present invention, it should be noted that the present invention further encompasses the various possible combinations and subcombinations of such aspects and features. Thus, for example, any aspect may be combined with an aforementioned feature in accordance with the present invention without requiring any other aspect or feature.

BRIEF DESCRIPTION OF THE DRAWINGS

One or more preferred embodiments of the present invention now will be described in detail with reference to the following drawings.

DETAILED DESCRIPTION OF THE INVENTION

Figure 1:
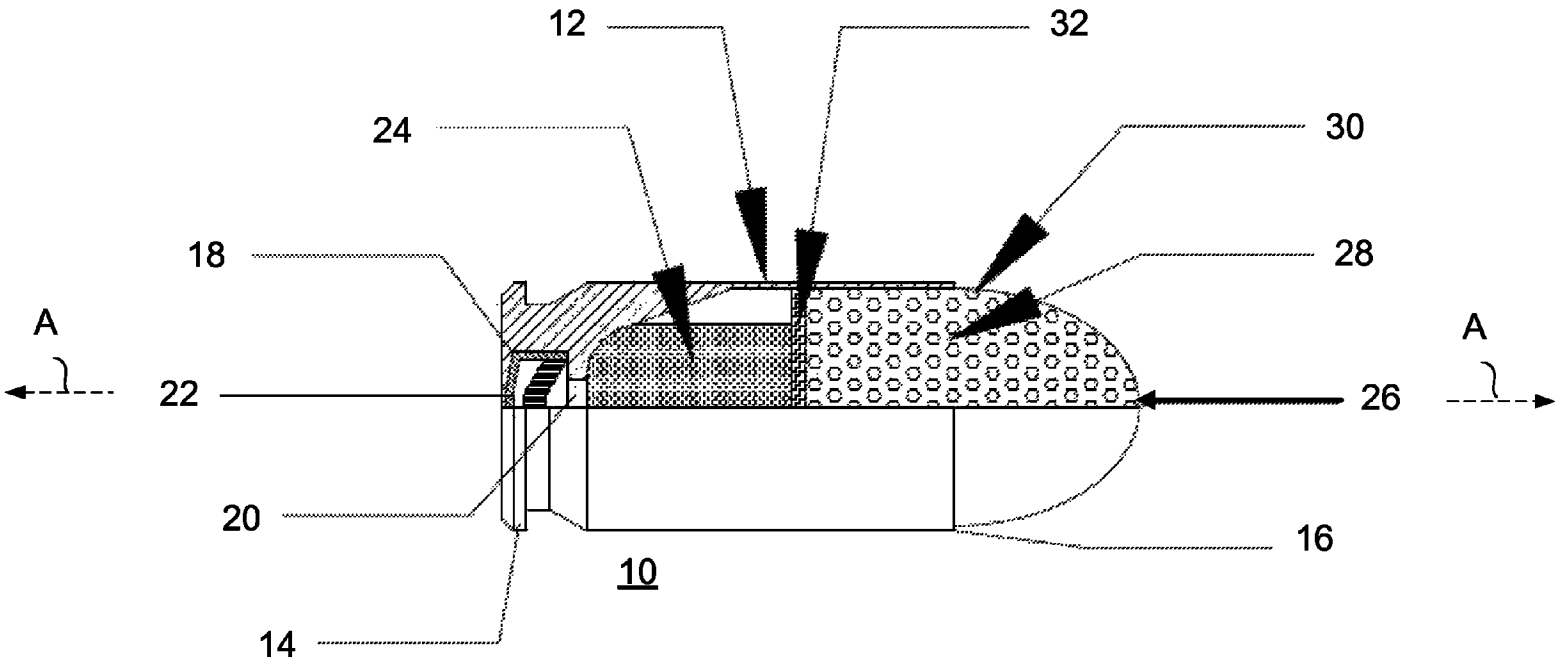
FIG. 1 illustrates a side elevational view, in partial cross-section, of a cartridge including a projectile constructed in accordance with a preferred embodiment of the present invention.
Figure 2A:
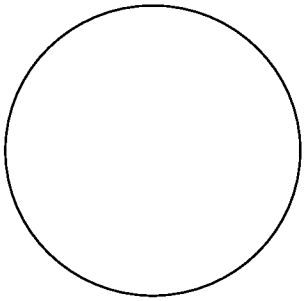
FIG. 2*a* illustrates a stabilizer in the form of a disc having a generally circular cross-sectional profile.
Figure 2B:
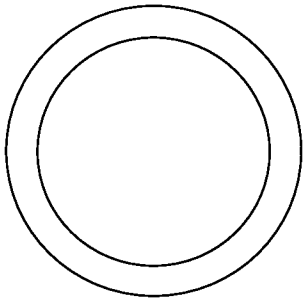
FIG. 2*b* illustrates a stabilizer in the form of an annulus or ring having a generally circular cross-sectional profile.
Figure 2C:
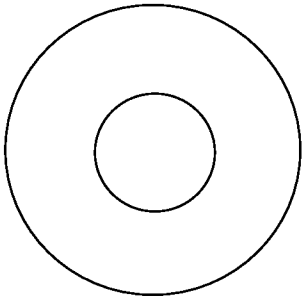
FIG. 2*c* illustrates a stabilizer in the form of a washer having a generally circular cross-sectional profile.
Figure 2D:
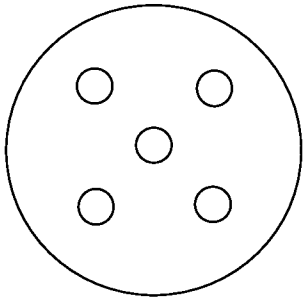
FIG. 2*d* illustrates a stabilizer defining a plurality of openings there through and having a generally circular cross-sectional profile.

As a preliminary matter, it will readily be understood by one having ordinary skill in the relevant art ("Ordinary Artisan") that the present invention has broad utility and application. As should be understood, any embodiment may incorporate only one or a plurality of the above-disclosed aspects of the invention and may further incorporate only one or a plurality of the above-disclosed features. Furthermore, any embodiment discussed and identified as being "preferred" is considered to be part of a best mode contemplated for carrying out the present invention. Other embodiments also may be discussed for additional illustrative purposes in providing a full and enabling disclosure of the present invention. As should be understood, any embodiment may incorporate only one or a plurality of the above-disclosed aspects of the invention and may further incorporate only one or a plurality of the above-disclosed features. Moreover, many embodiments, such as adaptations, variations, modifications, and equivalent arrangements, will be implicitly disclosed by the embodiments described herein and fall within the scope of the present invention.

Accordingly, while the present invention is described herein in detail in relation to one or more embodiments, it is to be understood that this disclosure is illustrative and exemplary of the present invention, and is made merely for the purposes of providing a full and enabling disclosure of the present invention. The detailed disclosure herein of one or more embodiments is not intended, nor is to be construed, to limit the scope of patent protection afforded the present invention in any claim of a patent issuing here from, which scope is to be defined by the claims and the equivalents thereof. It is not intended that the scope of patent protection afforded the present invention be defined by reading into any claim a limitation found herein that does not explicitly appear in the claim itself.

Thus, for example, any sequence(s) and/or temporal order of steps of various processes or methods that are described herein are illustrative and not restrictive. Accordingly, it should be understood that, although steps of various processes or methods may be shown and described as being in a sequence or temporal order, the steps of any such processes or methods are not limited to being carried out in any particular sequence or order, absent an indication otherwise. Indeed, the steps in such processes or methods generally may be carried out in various different sequences and orders while still falling within the scope of the present invention. Accordingly, it is intended that the scope of patent protection afforded the present invention is to be defined by the issued claim(s) rather than the description set forth herein.

Additionally, it is important to note that each term used herein refers to that which the Ordinary Artisan would understand such term to mean based on the contextual use of such term herein. To the extent that the meaning of a term used herein—as understood by the Ordinary Artisan based on the contextual use of such term—differs in any way from any particular dictionary definition of such term, it is intended that the meaning of the term as understood by the Ordinary Artisan should prevail.

Regarding applicability of 35 U.S.C. §112, ¶6, no claim element is intended to be read in accordance with this statutory provision unless the explicit phrase "means for" or "step for" is actually used in such claim element, whereupon this statutory provision is intended to apply in the interpretation of such claim element.

Furthermore, it is important to note that, as used herein, "a" and "an" each generally denotes "at least one," but does not exclude a plurality unless the contextual use dictates otherwise. Thus, reference to "a picnic basket having an apple" describes "a picnic basket having at least one apple" as well as "a picnic basket having apples." In contrast, reference to "a picnic basket having a single apple" describes "a picnic basket having only one apple."

When used herein to join a list of items, "or" denotes "at least one of the items," but does not exclude a plurality of items of the list. Thus, reference to "a picnic basket having cheese or crackers" describes "a picnic basket having cheese without crackers", "a picnic basket having crackers without cheese", and "a picnic basket having both cheese and crackers." Finally, when used herein to join a list of items, "and" denotes "all of the items of the list." Thus, reference to "a picnic basket having cheese and crackers" describes "a picnic basket having cheese, wherein the picnic basket further has crackers," as well as describes "a picnic basket having crackers, wherein the picnic basket further has cheese."

Referring now to the drawings, FIG. 1 illustrates an exemplary cartridge 10 constructed in accordance with a preferred embodiment of one or more aspects and features of the present invention. As shown in FIG. 1, the cartridge 10 includes a generally cylindrical casing 12 with a base 14 at one end, and a mouth 16 at the opposite end, at which a nose of a projectile 26 extends from the casing 12. The base 14 includes a primer pocket 18 with a flash hole 20 communicating with the interior of the casing 12. A conventional primer 22 is disposed in the primer pocket 18. A powder charge 24 of propellant (such as conventional smokeless gunpowder) is disposed in the interior of the casing 12, in communication with the flash hole 20. The casing 12 is of conventional construction, for example it may be drawn from brass or aluminum alloys or molded from plastic. Any commercially available casing is suitable for this purpose.

For the purposes of illustration, the example cartridge is a 11.4 mm (.45 in.) caliber Automatic Colt Pistol cartridge (commonly identified as ".45 ACP"); however, it will be understood that the present invention extends to any type or caliber of cartridge. It is also known to create "caseless" ammunition rounds wherein a propellant charge is loaded into a projectile having an extended base forming a powder enclosure, or wherein propellant is mixed with a suitable binder and molded into the shape of a cartridge case. In this type of ammunition the projectile is fixed in position relative to the propellant.

The projectile 26 is retained in the mouth 16 of the casing 12. The projectile 26 preferably comprises a non-metallic matrix 28 having a particulate filler 30 distributed there through. More specifically, the matrix 28 preferably is a polymer resin. A preferred toughened epoxy resin is an elastomer-modified epoxy functional adduct formed by the reaction of a bisphenol A liquid epoxy resin and a carboxyl terminated butadiene-acrylonitrile elastomer. The elastomer content is 40% by weight. This material is commercially available from The Dow Chemical Company under the trademark FORTEGRA™ 201.

The filler 30 may be any powder or particulate. The filler may comprise, for example, iron powder (U.S. standard mesh size 108). Other, non-limiting examples include lead, depleted uranium, copper, tungsten, bismuth, ceramic, bronze, iron and steel, clay, mica, silica, calcium carbide, and micro-encapsulated materials (wherein a selected material is encapsulated in a particulate-sized shell). In any case, the filler 30 preferably is of higher density than the cured matrix 28.

The projectile 26 may be lead-free. As used herein, the term "lead-free" refers to a projectile which does not have lead intentionally included in its composition and which includes lead only to the degree that it may be an unavoidable impurity in other components of the composition.

As shown in FIG. 1, the projectile 26 further includes a stabilizer 32 that is bonded to a base of the resin body formed by the non-metallic matrix 28. It is believed that the resin body is too soft to impart spin to the projectile when fired. It is believed that the stabilizer 32 has a sufficient hardness relative to the resin body so as to engage the rifling of a barrel of a firearm and impart rotation to the resin body—and hence the projectile—as the projectile travels through the barrel.

In the illustrated embodiment, the stabilizer 32 is disposed between the resin body and the powder charge 24. The stabilizer 32 may be glued or otherwise adhered to the resin body after the resin body is cured in the shape of a bullet, as shown in FIG. 1, or the stabilizer 32 may be adhered during a process of molding the resin body into the shape of the bullet. Moreover, while the stabilizer 32 is shown as being bonded to one of the opposite longitudinal ends of the resin body, i.e., the base, it is contemplated that the stabilizer 32 may similarly be bonded to the nose of the resin body, or at a location in-between the nose and the base of the resin body so as to divides the generally cylindrical portion of the resin body.

The stabilizer 32 may be made of copper, zinc, brass, or lead, for example. Indeed, the stabilizer 32 may be manufactured out of any material so long as the stabilizer 32 does not damage a barrel when engaging the rifling of the barrel and imparting spin to the projectile. In this respect, the use of a material harder than the barrel, such as stainless steel or steel, should be avoided.

It will be appreciated that the resin body is symmetrical about a longitudinal axis A of the resin body, which axis extends between opposite longitudinal ends of the resin body. The stabilizer 32 likewise preferably is symmetrical about a longitudinal axis of the resin body extending between opposite longitudinal ends of the resin body.

The stabilizer 32 is representative of the various stabilizers shown in FIGS. 2*a* through 2*d*, each having a different shape but nonetheless including a generally circular cross-sectional profile. The generally circular cross-sectional profile may be approximately the same diameter as a generally circular cross-sectional profile of the resin body; however, it is also contemplated that the generally circular cross-sectional profile of the stabilizer may be greater in diameter than that of the resin body, in which case the resin body itself may not engage the rifling.

Continuing with reference to FIGS. 2*a* through 2*d*, the stabilizer 32 may have the shape of a disc (FIG. 2*a*); an annulus or ring (FIG. 2*b*); a washer (FIG. 2*c*); or have a generally circular cross-sectional profile and further define a plurality of holes extending longitudinally there through (FIG. 2*d*), in which embodiment the resin may extend through the holes for a more secure bond. In a preferred embodiment, the stabilizer has the shape of a disc including a diameter of 0.449 inches, a width of 0.03 inches, and a weight of approximately 0.5 grams. In any case, the stabilizer 32 is bonded to the resin body and is configured to engage rifling of a barrel of a firearm and impart rotation to the resin body as the resin body travels through the barrel.

Based on the foregoing description, it will be readily understood by those persons skilled in the art that the present invention is susceptible of broad utility and application. Many embodiments and adaptations of the present invention other than those specifically described herein, as well as many variations, modifications, and equivalent arrangements, will be apparent from or reasonably suggested by the present invention and the foregoing descriptions thereof, without departing from the substance or scope of the present invention. Accordingly, while the present invention has been described herein in detail in relation to one or more preferred embodiments, it is to be understood that this disclosure is only illustrative and exemplary of the present invention and is made merely for the purpose of providing a full and enabling disclosure of the invention. The foregoing disclosure is not intended to be construed to limit the present invention or otherwise exclude any such other embodiments, adaptations, variations, modifications or equivalent arrangements, the present invention being limited only by the claims appended hereto and the equivalents thereof.

In various alternative embodiments, the projectile comprises a polymer bullet; the projectile comprises a thermoplastic; a particulate filler us distributed throughout the projectile, excluding the stabilizer; the projectile comprises a wooden bullet; the projectile comprises a rubber bullet; and the projectile comprise a wax bullet.

In making a projectiles and ammunition cartridge in accordance with one or more preferred embodiments of the invention, an epoxy resin is heated to an appropriate temperature to reduce its viscosity and permit mixing and distribution of a filler. The proper temperature is dependent on particle size. The finer the powder, the lower the viscosity needs to be for proper mixing. Next, the filler is mixed into the resin. After mixing, a conventional hardener (an amine) is added to the resin/filler mixture at a suitable ratio. As used herein, the term "hardener" refers to any type of curative agent for the resin. The mixture is then poured into a projectile mold for forming a bullet shape when the mixture cures. The resin/filler/hardener mixture is cured to produce an epoxy polymer, and the cured resin body is removed from the mold. The cured resin body in the shape of a bullet will have the filler distributed throughout. In accordance with preferred embodiments of the invention, a stabilizer is included in the mold during the curing of the mixture such that the resin body in the shape of a bullet cures around and bonds with the stabilizer. In alternatives, the stabilizer is glued or otherwise adhered to the cured resin body in the shape of a bullet after being cured and removed from the mold.

The mass of the resin bodies will vary depending on the type and amount of filler used, as well as the total length of the resin body. It is noted that the mass of the resin bodies can be varied from a baseline by changing either its density or its volume. This is limited by a need to maintain a certain minimum length to ensure that the resin bodies does not jam in a barrel. Resin bodies can be produced with a range of masses from less than 2.6 g (40 grains) to over 5.8 g (90 grains). The average density of a resin body can be less than 45% of the density of a lead projectile of equal exterior dimensions.

A range of 20% to 30% by weight of resin is preferred in some embodiment. The preferred proportion of resin will vary with various factors such as the type of resin and hardener, the type and size of filler, and so forth. In one particular embodiment, the composition of the resin bodies is 26% by weight resin and 74% by weight filler.

What is claimed is:

1. An ammunition cartridge for a firearm, comprising:

(a) a propellant; and (b) a projectile fixed in position relative to the propellant, the projectile comprising:

(i) a toughened polymer resin comprising an elastomer-modified epoxy functional adduct formed by the reaction of a bisphenol A liquid epoxy resin and a carboxyl terminated butadiene-acrylonitrile elastomer;

(ii) a particulate filler distributed through the resin; and (iii) a curative agent by which the toughened polymer resin with distributed particulate filler is cured;

(c) wherein the cured toughened polymer resin with distributed particulate filler comprises a resin body having an elongate, generally cylindrical portion extending between opposite longitudinal ends of the resin body; and (d) wherein the projectile further comprises a stabilizer bonded to the resin body and configured to engage rifling of a barrel of a firearm and impart rotation to the projectile as the projectile travels through the barrel.

2. The cartridge of claim 1, wherein the filler has a density greater than a density of the resin.

3. The cartridge of claim 1, wherein the resin body has an average density less than 45 percent of the density of lead.

4. The cartridge of claim 1, wherein the resin is 20 to 30 weight percent of the total projectile composition.

5. The cartridge of claim 1, wherein the filler is 70 to 80 weight percent of the total projectile composition.

6. The cartridge of claim 1, wherein the filler comprises tungsten.

7. The cartridge of claim 1, wherein the elastomer content is 40 percent by weight of the toughened polymer resin.

8. The cartridge of claim 1, wherein the filler is selected from the group consisting of: copper, tungsten, lead, depleted uranium, bismuth, bronze, iron and steel, ceramic, clay, mica, silica, calcium carbide, a micro-encapsulated material, and combinations thereof.

9. The cartridge of claim 1, wherein the resin body has the shape of a bullet.

10. An ammunition cartridge, comprising:

(a) a primer;

(b) a propellant;

(c) a projectile; and (d) a casing containing the primer, propellant and projectile, with the projectile projecting from the casing;

(e) wherein the projectile comprises:

(i) a toughened polymer resin comprising an elastomer-modified epoxy functional adduct formed by the reaction of a bisphenol A liquid epoxy resin and a carboxyl terminated butadiene-acrylonitrile elastomer;

(ii) a particulate filler distributed through the resin; and (iii) a curative agent by which the toughened polymer resin with distributed particulate filler is cured;

(iv) wherein the cured toughened polymer resin with distributed particulate filler comprises a resin body having an elongate, generally cylindrical portion extending between opposite longitudinal ends of the resin body; and (v) wherein the projectile further comprises a stabilizer bonded to the resin body and configured to engage rifling of a barrel of a firearm and impart rotation to the projectile as the projectile travels through the barrel.

11. The cartridge of claim 10, wherein the projectile has an average density less than 45 percent of the density of lead.

12. The cartridge of claim 10, wherein the resin is 20 to 30 weight percent of the total projectile composition.

13. The cartridge of claim 10, wherein the filler is 70 to 80 weight percent of the total projectile composition.

14. The cartridge of claim 10, wherein the filler comprises tungsten.

15. The cartridge of claim 10, wherein the elastomer content is 40 percent by weight of the toughened polymer resin.

16. The cartridge of claim 10, wherein the filler is selected from the group consisting of: copper, tungsten, lead, depleted uranium, bismuth, bronze, iron and steel, ceramic, clay, mica, silica, calcium carbide, a micro-encapsulated material, and combinations thereof.

17. The cartridge of claim 10, wherein the resin body has the shape of a bullet.

18. A method of making an ammunition cartridge for a firearm, the method comprising the steps of:

(a) mixing together to form a projectile that is fixed in position relative to a propellant, (i) a toughened polymer resin comprising an elastomer-modified epoxy functional adduct formed by the reaction of a bisphenol A liquid epoxy resin and a carboxyl terminated butadiene-acrylonitrile elastomer, (ii) a particulate filler distributed through the resin and (iii) a curative agent;

(b) introducing the mixture into a projectile mold having a cavity in a desired projectile shape;

(c) allowing the toughened polymer resin with distributed particulate filler to cure so as to form a resin body having an elongate, generally cylindrical portion extending between opposite longitudinal ends of the resin body; and (d) removing the projectile from the mold;

(e) wherein the method further comprises bonding a stabilizer to the resin body such that the stabilizer is configured to engage rifling of a barrel of a firearm and impart rotation to the projectile as the projectile travels through the barrel.

19. The method of claim 18, wherein the step of bonding the stabilizer to the resin body comprises placing the stabilizer in the mold prior to allowing the resin to cure.

20. The method of claim 18, wherein the step of bonding the stabilizer to the resin body comprises adhering the stabilizer to the resin body after removing the resin body from the mold.

* * * * *